US009945108B1

(12) United States Patent
Turner

(10) Patent No.: US 9,945,108 B1
(45) Date of Patent: Apr. 17, 2018

(54) TWO-PART DRAIN CLEANING DEVICE AND METHOD OF MAKING

(71) Applicant: Stephen S. Turner, Edelstein, IL (US)

(72) Inventor: Stephen S. Turner, Edelstein, IL (US)

( * ) Notice: Subject to any disclaimer, the term of this patent is extended or adjusted under 35 U.S.C. 154(b) by 0 days.

(21) Appl. No.: 15/445,963

(22) Filed: Feb. 28, 2017

(51) Int. Cl.
*E03C 1/302* (2006.01)
*B08B 9/045* (2006.01)

(52) U.S. Cl.
CPC ..... *E03C 1/302* (2013.01); *B08B 9/045* (2013.01)

(58) Field of Classification Search
CPC ..... E03C 1/302; B08B 9/045
USPC ..... 4/255.01
See application file for complete search history.

(56) References Cited

U.S. PATENT DOCUMENTS 566,110 A 8/1896 Wrigley
1,051,992 A 2/1913 Fisher et al.
1,588,737 A 6/1926 Hurd
2,717,437 A 9/1955 De Mestral
4,123,894 A 11/1978 Hughes et al.
5,231,738 A 8/1993 Higashinaka
5,769,960 A 6/1998 Nirmel
5,836,032 A 11/1998 Hondo
6,131,229 A 10/2000 Lincuna et al.
6,161,371 A 12/2000 Glesser
6,775,873 B2 8/2004 Luoma
6,827,794 B2 12/2004 Sommerfeld, Sr.
8,359,696 B1 1/2013 Turner et al.
2006/0021123 A1* 2/2006 Turner ..... E03C 1/302 4/255.01

* cited by examiner

*Primary Examiner* — Tuan N Nguyen
(74) *Attorney, Agent, or Firm* — Chandrakant C. Shroff

(57) ABSTRACT

A drain cleaning device with a combination of elements which quickly removes upper-drain hair clogs from bathroom drains without taking the drain apart, and without handling offensive clogs. The drain cleaning device includes a handle section and a disposable drain cleaning section which snap together. The drain cleaning section has an extended rod portion with a multistrand wire core covered with a layer of thousands of miniature hair-grabbing, hook elements embedded in a textile material which covers the rod portion's entire length. In particular, the J-shaped hook elements are circumferentially oriented on the rod portion to snag hair while rotating the device. Also, a method of making the device by assembling the disposable rod section from a length of hook strip, a length of multistrand wire core, a hook-covered tip and a connector, which can then be connected to the handle section before use.

2 Claims, 7 Drawing Sheets

TWO-PART DRAIN CLEANING DEVICE AND METHOD OF MAKING

BACKGROUND OF THE INVENTION

1) Field of the Invention

The inventive drain cleaning device relates to devices used for cleaning bathroom drains by removing hair that is collected in the upper portion of the drain where stopper or strainer mechanisms and other obstructions occur or collected anywhere along the drain pipe down to the bottom elbow bends of sink drains where hair has collected (i.e., the drain trap).

2) Description of Related Art

Bathroom drains are clogged most often by hair that enters the drain and collects from the drain trap at the bottom up to the drain opening. Most frequently the hair combines with sticky products such as soap, shampoo and toothpaste and builds a "log-jam" of sorts where these drain obstructions catch the hair. and some settles in the drain trap. After sufficient amounts of hair have collected in the drain trap or around the upper opening, the water from the sink basin begins to drain noticeably more slowly, and eventually can completely block the water from draining. Drain chemicals, home remedies such as baking soda and vinegar and plungers are frequently used for these clogs, but often fail to dissolve or dislodge the hair clogging the drain. In extreme cases, the only remaining remedy is to disassemble the drain or use a device that can effectively reach, snag and extract the hair, e.g. a drain snake.

Therefore, there is a need for devices or methods for cleaning the bathroom drain to unblock the drain of accumulated hair. The most frequent method used is a liquid or gel-based chemical agent, which can contain corrosive chemicals that may damage the drain structure. The drain cleaning chemicals may also cause health problems to those who handle the liquids or gels incorrectly. Another problem with chemical agents is that a significant portion of the chemical agent may flow past the hair-clog (for example, in the vertical portion of a bathroom sink drain) such that the chemical cannot effectively submerge the hair in order to completely dissolve it.

This invention uses a hook material layer bonded to a multi-strand cable in a drain cleaner device, in which the hook elements are all oriented in a circumferential direction on the cleaner rod and the rod is rotated to collect and grab onto the hair. These prior art documents show various drain cleaning tools: U.S. Pat. No. 566,110 issued to Wrigley shows an early drain snake with a rotatable handle; U.S. Pat. No. 1,051,992 issued to Fisher et al. shows a coil with hooks at the distal end that resemble fishing hooks; U.S. Pat. No. 1,588,737 issued to Hurd shows a pipe cleaner having a multistrand cable with rounded loops at the distal end; US Patent Application Publication No. 2009/0293214 filed by Ackerman et al. shows a handheld drain clog remover having a plurality of outwardly projecting barbs along its length (the barbs are all oriented axially); US Patent Application Publication No. 2012/0204334 filed by Floto et al. shows a disposable toilet declogging stick having serrated edges along its length (the serrations are oriented axially); U.S. Pat. No. 5,769,960 issued to Nirmel shows a toilet cleaning device having barbs on the distal portion of the device, FIG. 2B; U.S. Pat. No. 6,827,794 issued to Sommerfeld, Sr.; and, U.S. Pat. No. 6,131,229 issued to Lincuna et al. shows a pipe cleaning device having hook elements at its tip.

Another similar drain cleaning device is U.S. Pat. No. 6,775,873 issued to Luoma shows a plastic disposable strip with barbs along its edges to grab hair from a clogged drain. The hooks are all oriented axially toward the handle (i.e., proximal end).

Also, U.S. Pat. No. 5,836,032 issued to Hondo shows a drain cleaning device having an elongated shaft with hook members at the distal tip area, FIGS. 3-5, including both ring like hook element arrangements and helical arrangements on the shaft. However, this document appears to emphasize that the generally inverted J-shaped hooks are all oriented axially towards the handle of the device (rather than circumferential as required herein) and no 'orphan projections' (such as used in the present inventive device) are shown or mentioned. Also, This document is silent regarding the use of hook fastener material. Furthermore, this device will need to be cleaned before reuse, rather than having a disposable rod section.

U.S. Pat. No. 6,161,371 issued to Glesser shows a rope covered with hook and loop material along its length, and is used to facilitate fastening to itself or to another similar type of rope. This device cannot be used to remove hair from a drain, since it lacks the necessary stiffness.

U.S. Pat. No. 2,717,437 issued to De Mestral shows an early manufacture of hook and loop fastener material. FIG. 1 shows the hook elements formed by using a heating element (5 in FIG. 1) to melt part of the loop elements, leaving the generally inverted J-shaped hooks and raised pile threads (10 in FIG. 1), that can also be referred to as 'orphan projections'.

U.S. Pat. No. 5,231,738 issued to Higashinaka shows a combined hook/loop material having hooks and loops on same side of the sheet. FIG. 1(a) shows the hook elements all oriented in the same direction. FIG. 2(a) shows pairs of hook elements oriented in opposing directions. However, this document is silent regarding use in a drain cleaner device.

U.S. Pat. No. 4,123,894 issued to Hughes et al. shows a sealed wire rope having a surface covered with projecting fibers. The purpose here is to enhance the protection of the enclosed wire rope by sealing it and applying lubricant to the outer surface where its adherence is improved by the fibers.

BRIEF SUMMARY OF THE INVENTION

An exemplary embodiment of the invention is a drain cleaning device used to remove clogging hair from a bathroom sink, shower or bathtub drain, in which a reusable handle section is detachably connected to a disposable rod section.

The rod section of the exemplary embodiment includes an extended rod with aircraft control cable as its core and a covering along its entire length made of hook material, in which the individual hooks are oriented in a circumferential fashion (rather than axially or randomly). Its tip is a flattened portion of hook material only, without an inner aircraft cable core, making the tip more flexible for negotiating pipe bends in drains.

Benefits of this exemplary embodiment are: a) removing clogging hair by inserting the rod section into a drain, without removing a drain strainer that may be present (and without disassembling the drain), and rotating the handle to allow the hook elements to grab clogging hair. The device can be pulled out of the drain and then the rod section holding the clogging hair can be discarded. This benefits the user by not having to clean the tool or having to contact the offending, unsanitary hair clog.

BRIEF DESCRIPTION OF THE DRAWINGS

FIG. 5A shows the hook elements (with their corresponding orphan projections) arranged in transverse rows, with all hook elements oriented in the same transverse direction. FIG. 5B shows the transversely arranged hook elements in pairs of opposingly oriented hook elements. FIG. 5C shows the transverse-oriented hook elements in an angular arrangement, which will produce a helical arrangement in the rod section of the device.

DETAILED DESCRIPTION

Figure 1:
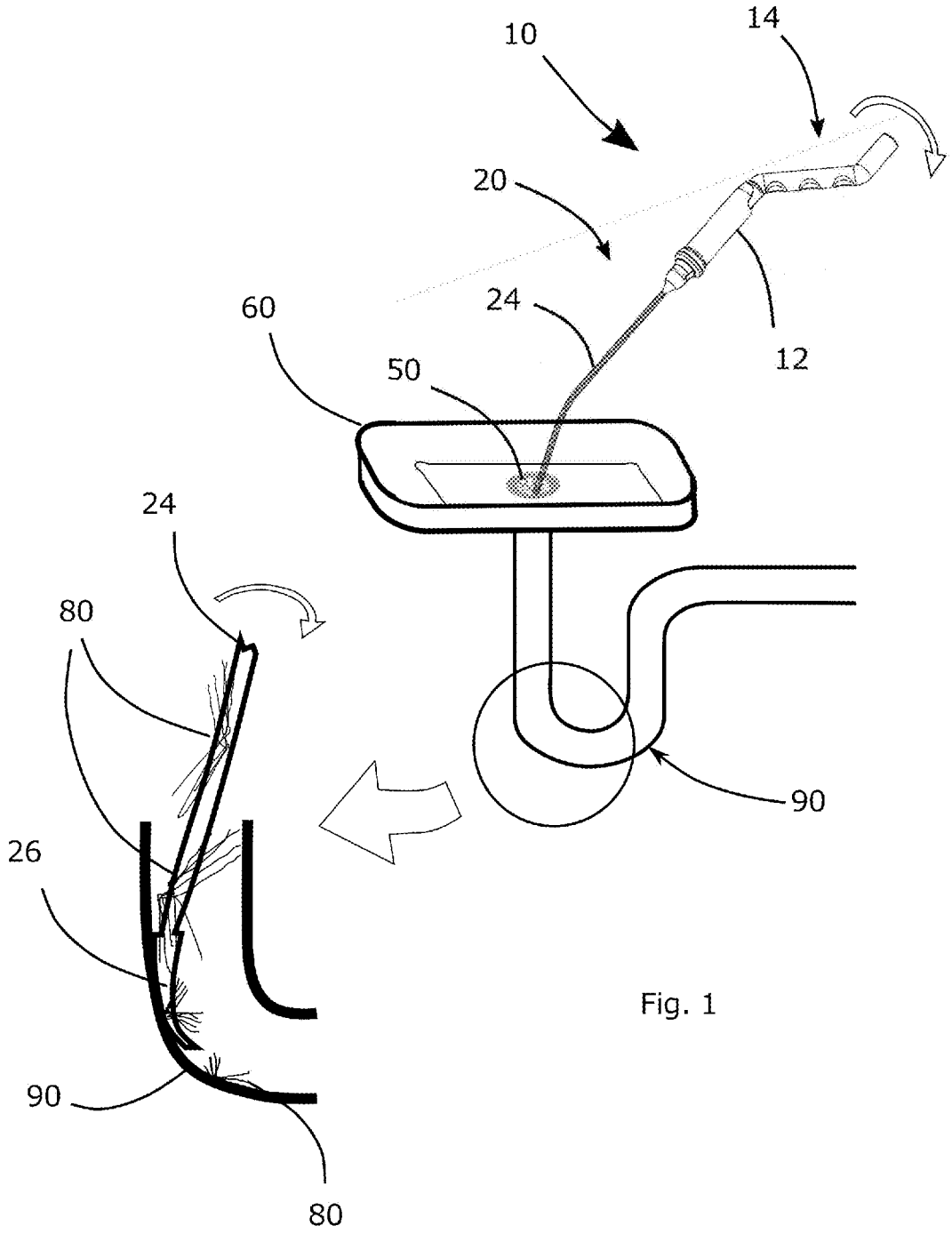
FIG. 1 is a perspective view and a blown-up partial view of the use of the inventive device in a bathroom sink, showing the device inserted through a conventional drain strainer (or 'cover'), to remove clogging hair from the drain.

FIG. 1 shows the inventive drain cleaner device 10 being used in a bathroom sink 60 to remove clogging hair 80 from the drain below. The drain cleaner device is constructed of two sections that are coupled together for use: a handle section 14 and a rod section 20. A sleeve 12, which is rotatable and axially movable on the handle section, covers the coupling between the handle and rod sections and allows the user to hold the device while the handle is rotated.

The diameter of the rod section of the device 20 is sufficiently narrow to be easily inserted through openings in a typical drain cover 50 all the way to the drain trap 90, often found in older residential bathrooms or modern drains having pop-up stoppers. After insertion of the rod section 20 into the drain, the handle section 14 is rotated, thus winding into and capturing the clogging hair. The particular construction of the hook surface of the rod section 24 and of the rod section tip 26, allows the hair to be collected and grabbed by the drain cleaner device. After grabbing the clogging hair, the device is removed from the drain and the entire rod section 20 can then be decoupled from the handle section 14. The rod section 20 with the collected hair 80 can be safely and environmentally discarded. A new rod section can then be coupled to the reusable handle section to remove hair from another clogged drain.

Figure 2A:
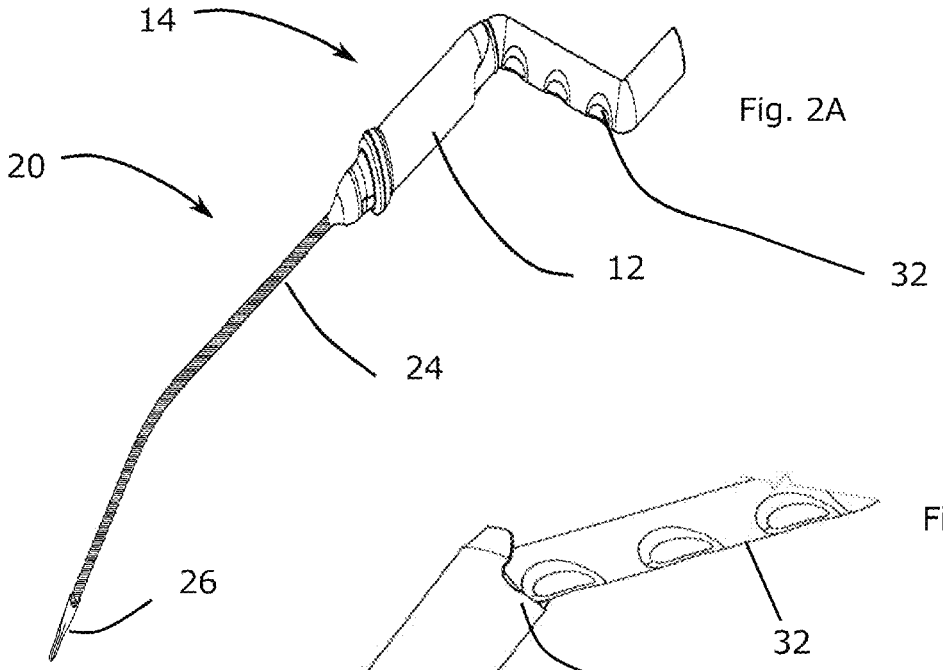
FIG. 2A is a perspective view of entire inventive device, in its coupled configuration, i.e., the handle section is fully attached to the rod section.

FIGS. 2A-D show various perspective views of the overall device structure in both the coupled and the uncoupled configuration. FIG. 2A shows the overall device with the coupled handle section 14 and rod section 20, including a handle 32, an elongated rod portion 24 with a tip 26. A rotatable and axially repositionable sleeve 12 on the handle section, is shown in its lowered position, covering the coupling connecting the handle section 14 and rod section 20.

Details of an exemplary coupling arrangement are provided in U.S. Pat. No. 8,359,696 (Turner et al.). This exemplary coupling arrangement is shown in FIGS. 2A-D. However, the coupling arrangement contemplated in this inventive device is not limited thereto; i.e., any suitable coupling structure that separates the durable handle section from the disposable rod section, and ensures that the handle section rotates the rod section during use, (e.g., with a rotatable sleeve that surrounds the coupling or any part of the rod section, for holding the device while rotating the handle), can be used. For example, any snap-fit connection with a rotatable sleeve can be used.

Figure 2B:
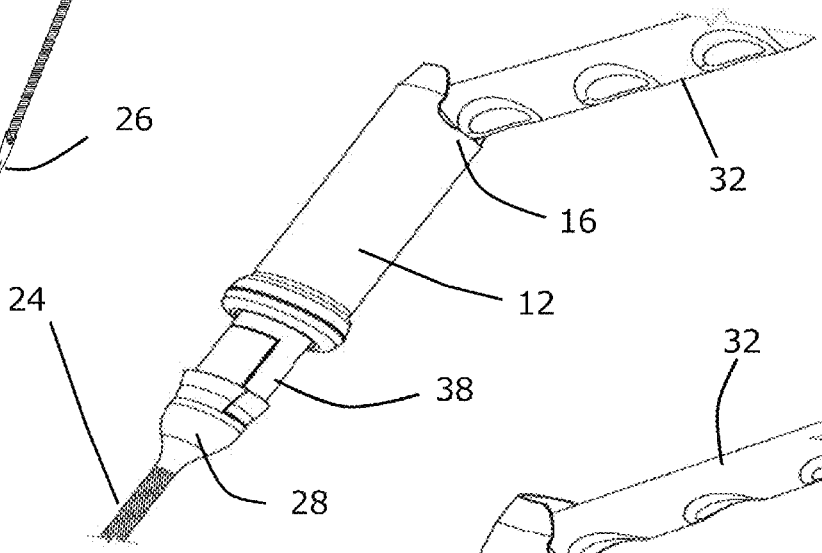
FIG. 2B is a close-up view of the coupling area of the device with the coupling sleeve pulled up to expose detailed coupling features.

FIG. 2B shows a close-up of the exemplary coupling (connector) 28 connecting the rod section and the handle section, with the sleeve 12 in its raised position to expose the coupling. As shown in this diagram, when the sleeve 12 is raised to permit the drain cleaner device to be uncoupled, the handle section, including the sleeve 12, can be separated from the rod section. The sleeve 12 has a scalloped proximal end (notch) 16 that locks the handle from rotation when the coupling is exposed. The distal coupling (connector) end 38 of the handle section provides an opposing and matching coupling configuration with the proximal end 28 of the rod section.

Figure 2C:
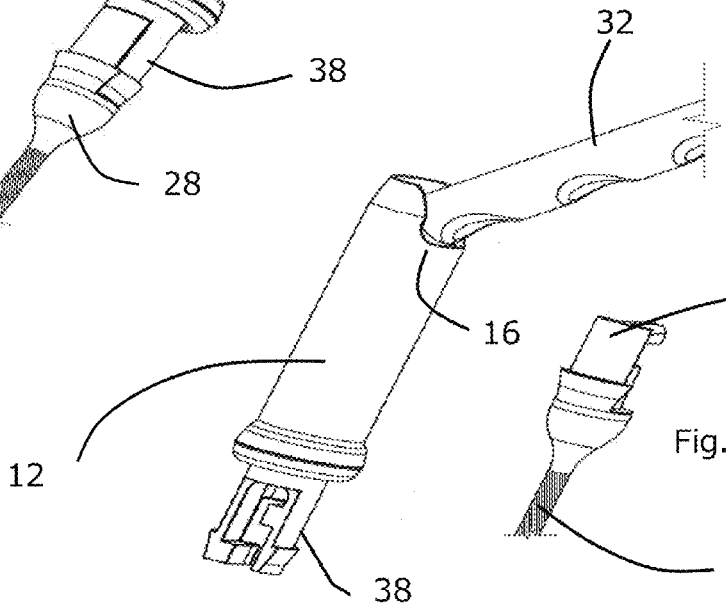
FIG. 2C is a close-up of handle section of the device, showing details of the coupling end, with the coupling sleeve in its raised position.
Figure 2D:
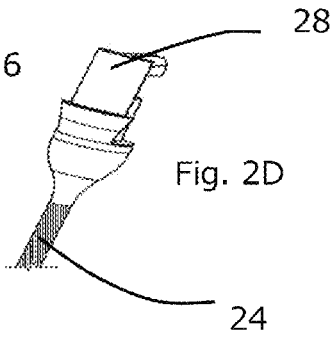
FIG. 2D is a close-up of the proximal end of the rod section of the device, showing the coupling end.

FIGS. 2C and 2D show the coupling end of the handle section and the coupling end of the rod section, respectively, in their uncoupled configuration. FIG. 2C shows the handle 32, movable sleeve 12 and handle section coupling end 38. The sleeve is in its raised position and the scalloped end (notch) 16 prevents the handle 32 from rotating when the coupling is exposed. FIG. 2D shows the coupling end 28 of the rod section with the elongated rod extending distally.

Figure 3C:
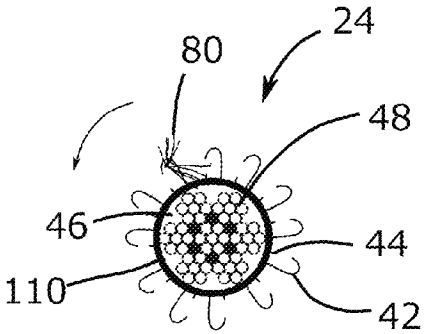
FIG. 3C is a transverse cross-section of the elongated rod of FIG. 3A, showing a multistrand core (aircraft control cable) surrounded by hook material.
Figure 3D:
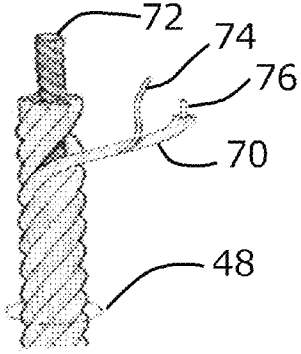
FIG. 3D is a perspective partial cutaway view of an exemplary multistrand aircraft cable used in the inventive device.
Figure 3B:
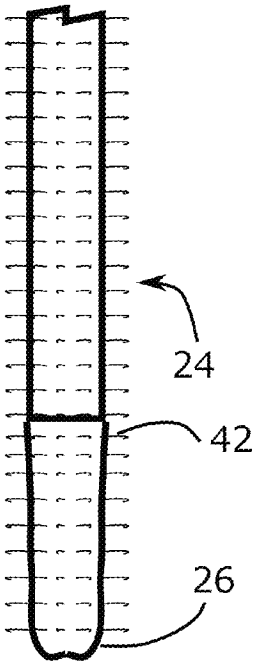
FIG. 3B is a 90 degree rotated view of FIG. 3A (i.e., rotated with respect to the rod axis), showing the difference in tip width.
Figure 3A:
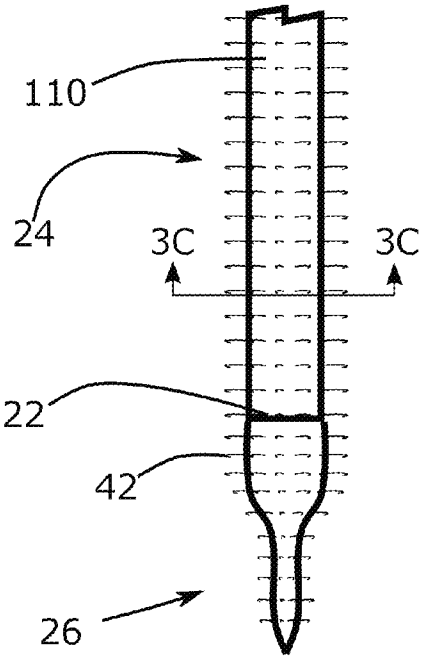
FIG. 3A is an elevation view of the distal end of the rod section, including the flexible rod tip and part of the rod portion, showing a first arrangement of hook elements.

FIGS. 3A-D show various details of the elongated rod portion 24 and the tip 26, particularly the features of the hook elements. FIG. 3A shows an elevation view of the distal end of the rod, with the elongated rod portion 24 connected to the rod tip 26, and a plurality of hook elements 42. The tip can be adhesively bonded to the distal end of the rod using any suitable bonding agent, e.g., a two-part epoxy.

FIG. 3B is a side view of FIG. 3A, showing that the tip 26 is a generally flattened structure covered with hook elements 42. FIG. 3C is a cross-section of the rod in FIG. 3A showing structural details. In particular, the core of the rod section 24 is a stranded wire rope 48, having a plastic coating 46, which is surrounded by a hook material substrate layer 110 with a plurality of hook elements 42. The plastic coating 46 impregnates the stranded wire rope as well as provides a coating over the wire rope that can adhere to the hook material layer 110 using heat and pressure bonding using a separate bonding adhesive.

The stranded wire rope core 48 is preferably a coated aircraft control cable, e.g., a cable designated as '7×7 aircraft cable' which is specified in detail in military standard specification MIL-DTL-83420 Rev. M, with a maximum diameter of 3/32" (2.38 mm), coated with vinyl or nylon. The specification describes the cable as being stainless steel. When combined with the hook material, the overall diameter of the rod portion is about 1/8" (3.18 mm) to 3/16" (4.76 mm), depending on the thickness of the hook material layer; the height of the hook elements from the hook sheet is excluded from these rod portion diameters as they are resilient and easily lay against the hook (substrate) layer when the rod portion is pushed through a narrow opening.

Regarding the plastic coating 46 on the aircraft control cable, this invention contemplates using a hot melt adhesive to bond the hook material substrate layer 110 firmly and permanently to the coated cable core (using heat and pressure). Therefore, the hot melt adhesive must be compatible with the plastic coating 46 on the cable. The bonded hook material and cable core must withstand the bending and friction that occurs when the rod portion 24 is passed through the drain strainer (or stopper) and is rotated. An example of a suitable type of hot melt adhesive is ethylene vinyl acetate. However, any suitable thermoplastic composition that ensures that the hook material is permanently bonded to the coated multiwire cable 48, e.g., by applying heat and pressure, can be used.

Alternatively, the underside of the hook substrate layer 110 can be provided with a suitable pre-applied adhesive that can bond the hook layer firmly to the cable 48.

The hook substrate layer 110 can be a woven layer of nylon or polyacetate fibers. The hook elements and orphan projection can be made of the same fibers as the woven substrate, but must have sufficient stiffness to be able to hold the collected hair during use of the device, without breaking off or detaching. Alternatively, the hook substrate layer can be a nonwoven or any other suitable textile or plastic layer on which the individual hook elements and orphan projections can be firmly attached.

FIG. 3D shows an exemplary multistranded cable structure that can be used in the present invention. A central multistrand rope 72 is surrounded by several multistranded (twisted) ropes 70. Each rope 70 can include a central wire 76 surrounded by multiple twisted wires; an individual wire 74 is identified for comparison. Multistrand cables can be provided with as few as seven wires, i.e., a central wire surrounded by six wires (typically referred to as a "1×7" cable). The wires are typically made of stainless steel, e.g., 316SS. The designation of "1×7" indicates that each strand (first number) has only one wire, and has seven 'strands' (second number), in which a central strand is surrounded by six more strands. Other cable arrangements that are encountered in narrow-width multistrand cables are: 1×19 (single wire strands in which a central strand is surrounded by six strands, which are, in turn, surrounded by another 12 strands); 7×7 (seven wires per strand with a central strand surrounded by seven additional strands); and, 7×19 (19 wires per strand with a central strand surrounded by seven additional strands). See www.chain-cable.com/cables.htm for these arrangements.

The impregnating plastic agent and/or the coating on the cable can be PVC (polyvinylchloride or "vinyl"), silicone, polytacrylate, nylon (polyamide) or any other suitable plastic composition. However, any multistranded cable structure that provides the flexibility and other mechanical properties described herein, that can be used to collect hair from a drain, and is suitably impregnated and coated to permanently bond to the hook material substrate, is contemplated by the present invention.

The mechanical properties of the rod portion 24 are determined by the type of multistrand rope 72 and it has a limited range of flexibility, such as required by the specification for aircraft control cables. In the present invention, the minimum amount of flexibility necessary is determined by two factors: the angle at which the device is inserted into the drain and the bend radius of the drain pipe elbow 90. Also, the rod portion 24 must have sufficient flexibility to flex during rotation. The characteristics of multistrand core differ considerably from those of a single metal rod core, which is used in some commercially available drain cleaner devices. Most notably, single rod core drain cleaner devices can be bent into any configuration but do not revert back to their straightened configuration on their own.

The rod tip 26 has a greater flexibility than the rod portion (since it consists only of flattened hook material and does not contain the more stiff aircraft cable), allowing it to flex more for negotiating pipe joints and turns, thereby making greater contact with the internal drain surface during use, as the handle is rotated. The rod tip 26 is attached to the distal end of the rod portion 24 during manufacture, e.g., using an epoxy adhesive at the junction 22 between the rod tip 26 and the rod portion 24.

The hook elements 42 are shown to be in a substantially circumferential orientation in FIG. 3C. Also, the hooks shown in these drawings are all oriented in the a circumferential orientation in the final rod portion 24. In addition, in order to enhance the 'grabbing and holding' behavior of the device on hair it encounters in the clogged drain, an additional orphan projection 44 shown in FIG. 3C is provided. The hook elements 42 have an inverted "J"-shape, which combines with their corresponding orphan projections 44 to form a "C"-shape that allows for the capture of collected hairs, during use of the device. They are also shown to be arranged in a banded pattern along the length of the rod portion 24.

Figure 4A:
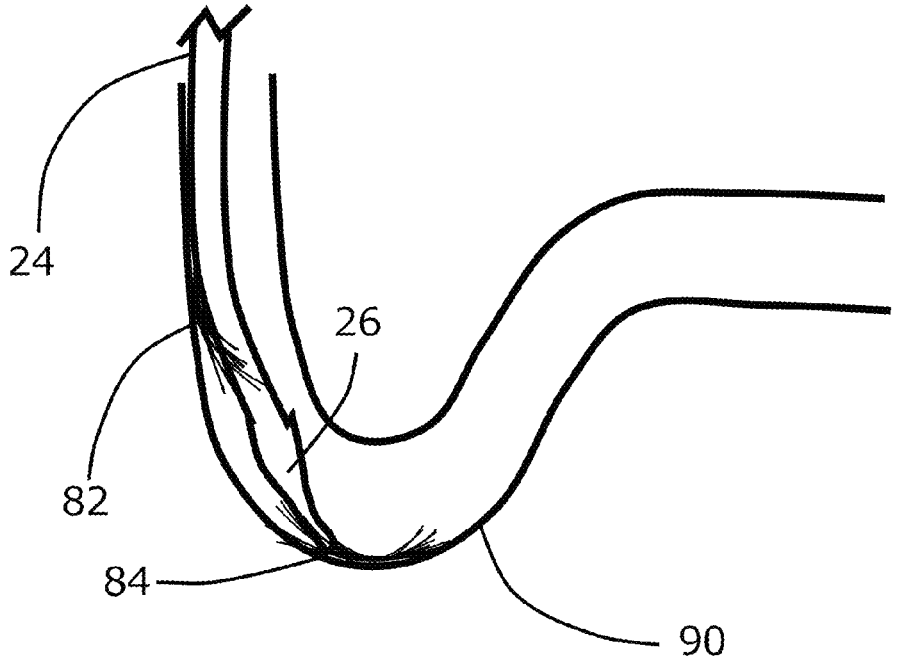
FIGS. 4A-B are two elevational views of the distal end of the rod section grabbing and removal clogging hair from a drain pipe.
Figure 4B:
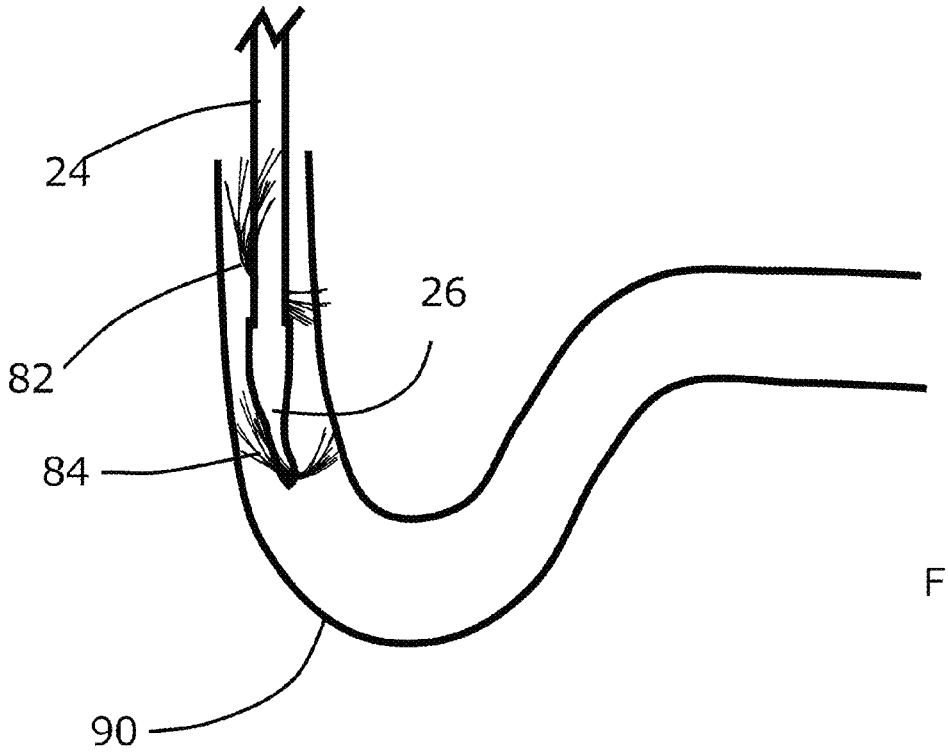

In FIGS. 4A-B, the rod tip 26 is shown in two elevational positions inside the drain pipe 90, with hair 82, 84 being collected by both the rod portion 24 and the tip 26, respectively. The hairs are grabbed during rotation of the handle, and held by the "C"-shaped gap formed by the hook elements and respective orphan projections. After sufficient rotation of the handle to collect the clogging hairs, the device is removed from the drain, pulling and lifting the collected hair from the drain, as in FIG. 4B.

The hair 82 held on the upper rod portion 24 is collected from the upper region of the drain, especially from the area of the drain strainer (50, FIG. 1) or a drain stopper. By contrast, the hair 84 held on the rod tip 26 is collected from the lower regions of the drain, or from the drain trap 90.

The invention also contemplates a method for making the rod section of the device. Since there can be some variation in the distance from the drain strainer to the drain elbow, this invention also contemplates providing rod sections with different lengths. Therefore, a consumer can purchase a rod section having the length appropriate for their particular sink and drain system. In the method of making the device, the hook elements in the resulting device are all oriented in a circumferential direction, corresponding directly with the inventive device.

In order to combine the hook material with the central multistrand cable, both are provided initially as indefinite length forms, i.e., from a cable reel and from a sheet roll. The width of the hook material corresponds to the circumference of the multistrand cable plus bonding agent (cable coating). Both indefinite length forms are combined with the thermoplastic coating/impregnant of the cable used to bond the hook material to the cable in apparatus that are considered to be well known to those skilled in this field of manufacture.

Figure 5A:
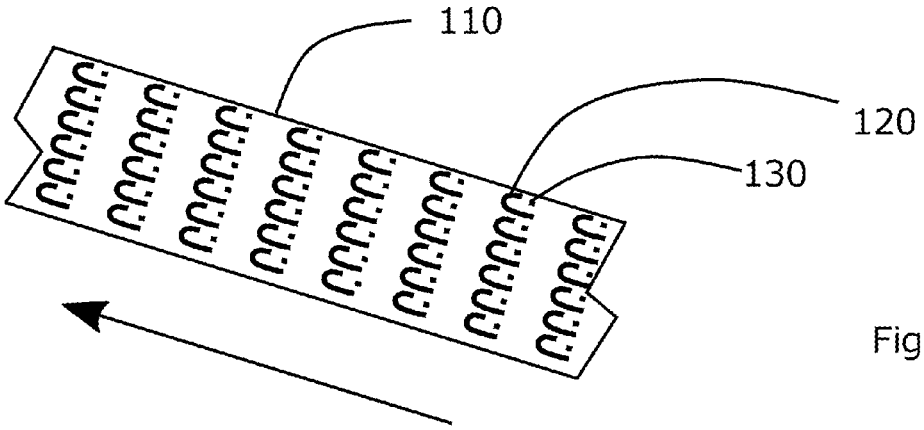
FIGS. 5A-C are three overhead views of portions of indefinite length hook material sheet with different exemplary arrangements of the hook elements on the sheets, but with each hook element oriented in a transverse orientation, along with a corresponding orphan projection.
Figure 5B:
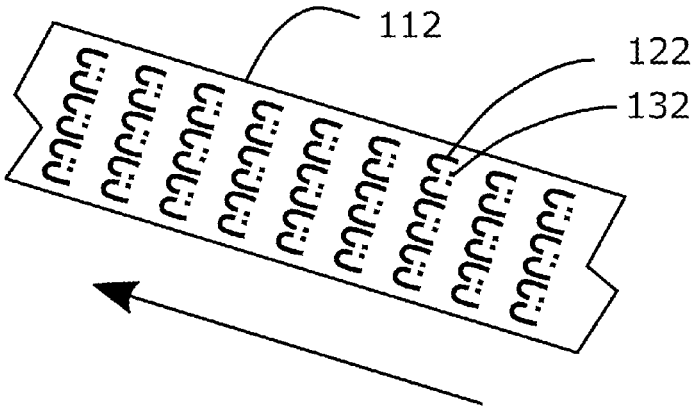
Figure 5C:
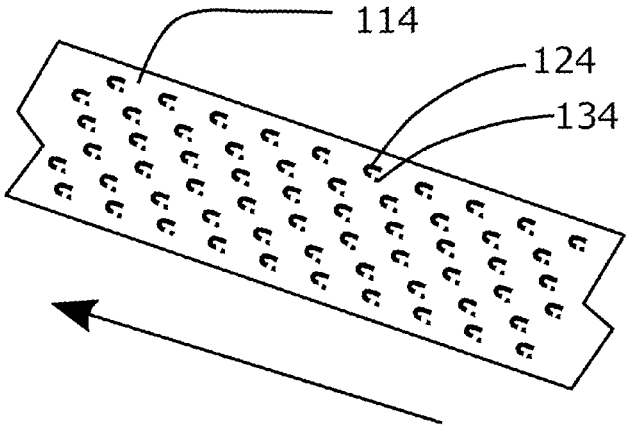

Also, although the hook arrangement shown in FIGS. 5A-C shows all the hook elements being arranged in a cross-striped pattern with all hook elements in the same transverse/circumferential orientation, other arrangement patterns are contemplated, with the requirement that all the hooks continue to have the same transverse/circumferential orientation. These are shown in FIGS. 5A-C.

FIG. 5A shows an indefinite strip of hook material 110 having a transversely striped pattern of hook elements 120 and corresponding orphan projections 130. All hook elements 120 are oriented in the same direction. This arrangement corresponds to the banded pattern arrangement shown in FIGS. 3A-C.

FIG. 5B shows an alternative arrangement in which the hook material strip 112 has a transversely striped pattern of hook elements 122 and orphan projections 132, but pairs of the hook elements have oppositely oriented hook elements. Therefore, after being applied to the cable core, the circumferentially oriented hook elements will have orientations in both directions of rotation (i.e., both clockwise and counterclockwise directions of orientation) on the elongated rod portion. The hook elements will also form a banded pattern arrangement along the length of the rod portion.

FIG. 5C shows another alternative arrangement in which the hook elements 124 and their orphan projections 134 are in an angular pattern on the hook material strip 114. Applying this strip to a cable core results in a helical pattern of hook elements on the circumference of the elongated rod portion.

Figure 5D:
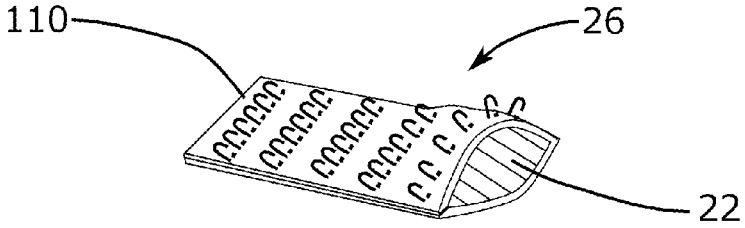
FIG. 5D shows a close-up perspective view of the rod tip 26 before it is attached to the distal end of the rod portion.

FIG. 5D shows a close-up of the rod tip 26, with the transversely-oriented hook elements and orphan projections shown in a transverse banded arrangement. The rod tip 26 is made by folding over a short strip of hook material 110, leaving an opening 22. The tip 26 is bonded to the distal end of the rod portion at the opening 22. A bonding agent, such as a 2-part epoxy, can be used to attach the tip 26 to the end of the rod portion. However, any suitable adhesive agent that satisfactorily permanently bonds the rod tip 26 to the distal end of the rod portion 24.

The rod tip 26 is made from a short strip of the same hook material 110 used to make the elongated rod portion, having the same hook element arrangement as shown in any of FIGS. 5A-C. The short strip can be 1-2 inches (2.5-5 cm) in length. The strip is folded over onto itself with the hook elements exposed on the two outer surfaces and the two layers are bonded to each other at one end only. The bonding at the one end can be by heat and pressure or by a suitable applied bonding agent. The opposite unbonded end is then bonded to the distal end of the elongated rod portion using an appropriate bonding agent.

Figure 5E:
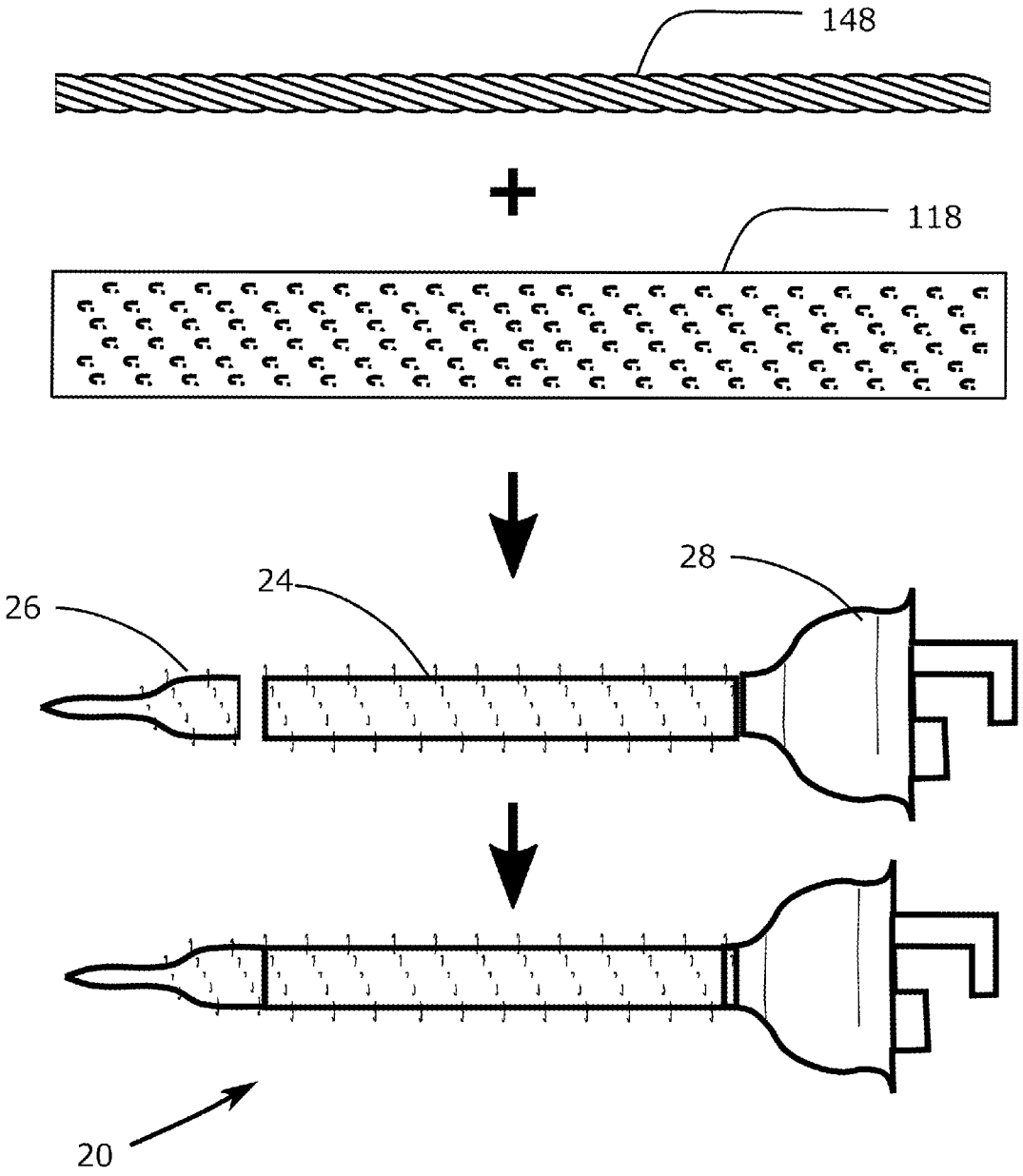
FIG. 5E shows a diagram illustrating the method of making the disposable rod section of the device.

FIG. 5E shows a diagram illustrating the method of making the disposable rod section 20 of the inventive device, starting with a given length of the multistrand cable 148 and the same length of the hook fastener strip 118. The hook strip 118 is wrapped lengthwise around the multistrand cable 148. This forms the rod portion 24. Then the rod coupling 28 is bonded to or otherwise attached to one end of the rod portion 24, and the rod tip 26 is bonded to or otherwise attached to the opposite end of the rod portion 24. This results in the fully assembled, disposable rod section 20.

Figure 6:
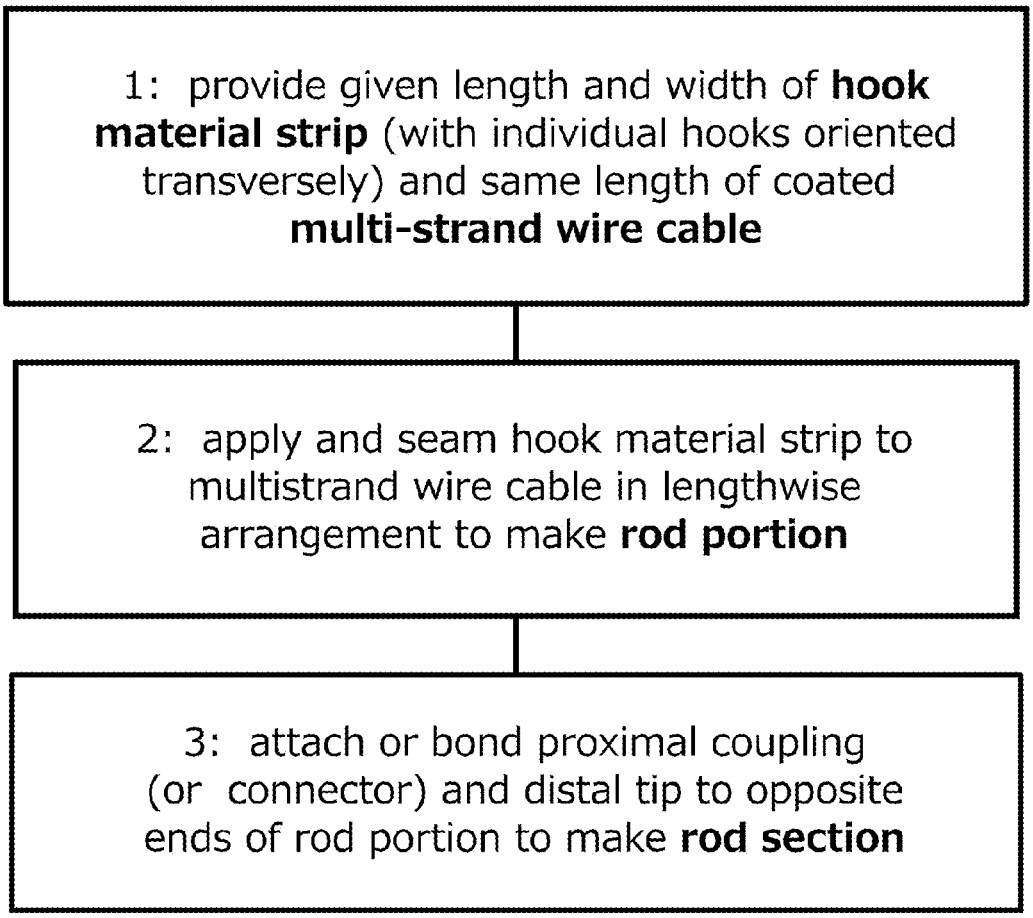
FIG. 6 is a three-box flow diagram showing the steps for making the rod section of the device.

FIG. 6 shows a three-box flow diagram showing the major method steps for making the rod section, which directly correspond with the inventive device structure. The first step is to provide a given length and width of hook material strip and an equal length of coated multi-strand wire cable. The hook elements are oriented in a transverse direction on the hook material strip, so that after the hook material has been applied and bonded to the wire cable, all hook elements are oriented in a circumferential direction (as opposed to an axially-oriented direction).

The second step is to bond the combined hook material and multi-strand narrow cable core, permanently attaching them together. Any suitable adhesive to bond the hook material strip seam may be used, that permanently bonds the hook material sheet to the cable core. Finally, the coupling and the tip are attached to the elongated rod portion to complete the rod section.

The coupling end of the rod section, and the handle section (including sleeve) can be made by plastic molding in a manner well known in the field of plastic manufacture. The rod section coupling end can have a hole drilled into it to force the rod portion into the coupling end to strengthen connection between these two parts. Also, the bonding agents used to attach the coupling end and the tip to the elongated rod may or may not be the same as the bonding agent used to bond the hook material strip to the cable core, and are considered to be well known in the field of consumer product manufacture.

Figure 7:
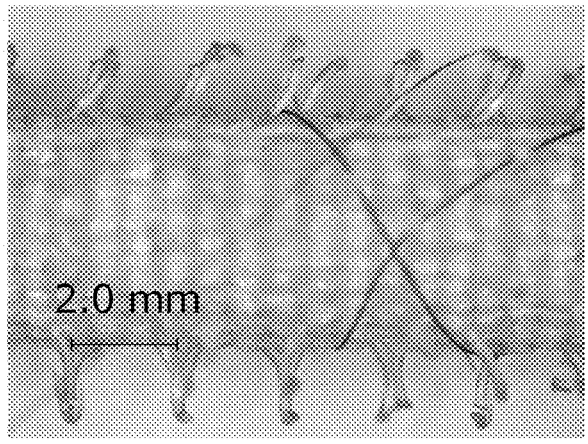
FIG. 7 is a photomicrograph showing a close-up of a 1 cm section of the rod portion.

FIG. 7 shows a photomicrograph of a 1.1 cm length of the rod portion in an exemplary device after a single use. A hair is shown grabbed onto by hook elements. A typical hair has a thickness of about 30-110 microns (30-100 μm or 0.030-0.100 mm). In this exemplary embodiment, the hook elements have a thickness of 0.5 mm and the hook material substrate is a woven mat.

The hook elements shown on the lower part of this photomicrograph are projecting 90° from the surface of the substrate. The hook elements on the upper part of this figure are angled relative to the substrate surface, due to use of the device. However, all of the hook elements are oriented with the J-shape directed circumferentially in accordance with the invention. Also, the hook elements in this figure are shown arranged in a banded pattern.

The invention claimed is:

1. A drain cleaning device for removing clogging hair from a bathroom drain comprising:

a disposable elongated rod section and a reusable handle section, the rod section and handle section capable of being coupled together to form the drain cleaning device;

the disposable rod section, having a connector at a proximal end of the rod section which is capable of being coupled with a corresponding connector on a distal end of the handle section, the rod section including, an elongated core with an outer covering of a configured hook material strip bonded to the surface of the elongated core and extending the entire length of the elongated core, and having a plurality of hook elements shaped as inverted J-shaped projections, all having the tops of the J-shapes extending radially outwardly from the bonded hook material strip, the elongated core and the bonded hook material strip together forming a rod portion of the rod section, the configuration of the plurality of hook elements on the bonded hook material strip all being in a circumferential direction to maximize the capability of the hook elements to grab onto hair present in the drain during rotation of the rod section when rotating a handle, the elongated core being a metallic twisted multistrand cable, the cable having a first flexibility, the proximal portion of the rod section having a coupling connector attached to the proximal end of the rod section, that provides a coupling structure that is capable of coupling with a corresponding coupling connector on a distal end of the handle section, thereby rendering the device ready for use, and, a distal tip with a plurality of circumferentially or laterally oriented hook elements, attached to the distal end of the rod section, having a flattened tip portion for guiding the distal tip in and through drains, and having a second flexibility that is greater than the first flexibility of the metallic twisted multistrand cable, the handle section including, the handle at a proximal end of the handle section, the handle section coupling connector at the distal end of the handle section having a structure corresponding generally in opposite, coupling arrangement to the proximal rod section coupling structure, wherein the hook elements on the bonded hook material strip are arranged in either a banded or a helical pattern along the entire length of the rod section between the coupling end and the rod tip, and, whereby, when the distal end of the rod section is inserted into a drain clogged with hair, rotation of the handle will cause the rod section to rotate and cause the circumferentially oriented hook elements to grab and collect hair, and, when the device is removed from the drain, the collected hair will be removed with the device and the user can discard the combined clog and rod section to avoid unsanitary contact.

2. A method for making a drain cleaning device for removing clogging hair from a bathroom drain comprising the steps:

providing a disposable elongated rod section and providing a reusable handle section, the rod section and handle section, each having a proximal and a distal end, being capable of being coupled together to form the drain cleaning device;

wherein the step of providing the disposable elongated rod section comprises, providing a length of an elongated core and providing the same length of a configured hook material strip, the configured hook material strip having a two-sided sheet substrate with an upper surface and a lower surface, and a plurality of hook elements extending from the upper surface of the substrate, the hook elements being shaped as inverted J-shaped projections, all having the tops of the J-shapes extending from the upper surface of the hook material strip, the elongated core and the bonded hook material strip together forming a rod portion of the rod section, the elongated core being a metallic twisted multistrand cable, the cable having a first flexibility, wrapping the configured hook material strip around and bonding to the elongated core, such that the hook material strip fully encloses the outer surface of the elongated core and extends the entire length of the elongated core, wherein the hook elements on the bonded hook material strip are all configured in the circumferential direction, with the curved ends of the J-shaped hook elements are all in a circumferential direction to maximize the capability of the hook elements to grab onto hair present in the drain during use of the device, attaching a coupling connector to the proximal end of the rod portion that is capable of coupling with a corresponding coupling connector on a distal end of the handle section, and, attaching a distal tip with a plurality of hook elements to the distal end of the rod portion, the distal tip having a flattened tip portion for guiding the distal tip in and through drains, the distal tip having a second flexibility that is greater than the first flexibility of the metallic twisted multistrand cable, the step of providing the handle section including, providing a handle as the proximal end of the handle section, and, attaching a coupling connector to the handle as the distal end of the handle section, whereby the hook elements on the bonded hook sheet material are arranged in either a banded or helical pattern along the entire length of the rod section between the coupling end and the tip, and, coupling the rod section to the handle section, thereby rendering the device ready for use, whereby, when the distal end of the fully coupled device is inserted into a drain clogged with hair, rotation of the handle will cause the rod section to rotate and cause the hook elements to grab and collect hair, and, whereby, when the device is removed from the drain, the hair will be removed as well and the user can discard the combined clog plus rod section to avoid unsanitary contact.

* * * * *